US010079451B2

(12) United States Patent
Henry et al.

(10) Patent No.: US 10,079,451 B2
(45) Date of Patent: Sep. 18, 2018

(54) PULL TAB DEVICE FOR A LATCH OF A PLUGGABLE MODULE

(71) Applicant: TYCO ELECTRONICS CORPORATION, Berwyn, PA (US)

(72) Inventors: Randall Robert Henry, Harrisburg, PA (US); Brandon Michael Matthews, McAlisterville, PA (US); Tracy Lee Smith, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/350,638

(22) Filed: Nov. 14, 2016

(65) Prior Publication Data

US 2018/0138635 A1 May 17, 2018

(51) Int. Cl.
*H01R 13/633* (2006.01)

(52) U.S. Cl.
CPC ..... *H01R 13/6335* (2013.01)

(58) Field of Classification Search
CPC .. H01R 24/64; H01R 25/006; H01R 2107/00; H01R 13/6658; H01R 25/00; H01R 25/162; H01R 13/6335; H01R 2201/04; H01R 13/6275; H01R 25/16; H01R 13/514; H01R 2103/00; H01R 24/78; H01R 27/02
See application file for complete search history.

(56) References Cited

U.S. PATENT DOCUMENTS 4,755,144 A * 7/1988 Gordon ..... H01R 13/6485 24/170
5,396,684 A * 3/1995 Yocom ..... F16L 3/233 24/16 PB
5,752,848 A * 5/1998 Youngmark ..... H01R 13/6392 24/129 R
6,735,070 B2 * 5/2004 Antila ..... A61N 1/14 361/220
6,887,091 B1 5/2005 Wu
7,160,135 B1 1/2007 Wu
7,318,740 B1 1/2008 Henry et al.
7,402,070 B1 * 7/2008 Wu ..... H01R 13/635 439/152
7,422,457 B1 * 9/2008 Wu ..... G02B 6/4201 439/258
7,473,124 B1 1/2009 Briant et al.
7,651,361 B2 1/2010 Henry et al.
8,506,319 B2 8/2013 Ritter et al.
9,246,262 B2 1/2016 Brown et al.
9,250,402 B2 2/2016 Ishii et al.
(Continued)

*Primary Examiner* — Truc Nguyen

(57) ABSTRACT

A pluggable module includes a pluggable body extending between a cable end and a mating end opposite the cable end and a latch held by the pluggable body having an actuation end and a latching end. The actuation end has an actuator extending from the cable end and the latching end has a latching tooth configured to latchably secure the pluggable module to a component. A pull tab device is secured to the actuator. The pull tab device has a handle configured to be pulled away from the pluggable body to release the latch. The pull tab device has a connecting end opposite the handle having a first segment and a second segment. The first segment wraps around the actuator and is secured to the second segment such that the pull tab device is self-secured to the actuator.

20 Claims, 3 Drawing Sheets

(56) References Cited

U.S. PATENT DOCUMENTS

| | | | | |
|---|---|---|---|---|
| 2008/0127461 | A1* | 6/2008 | Linden | A45F 5/02 24/302 |
| 2011/0250791 | A1* | 10/2011 | Straka | H01R 9/034 439/607.09 |
| 2012/0214345 | A1* | 8/2012 | Wu | H01R 13/6583 439/607.19 |
| 2012/0220152 | A1* | 8/2012 | Wu | H01R 13/6335 439/350 |
| 2012/0329305 | A1* | 12/2012 | Ritter | H01R 13/6275 439/350 |
| 2013/0115794 | A1* | 5/2013 | Chang | H01R 13/6335 439/160 |
| 2013/0280932 | A1* | 10/2013 | Lindkamp | G02B 6/4246 439/152 |
| 2014/0235091 | A1* | 8/2014 | Wang | H01R 13/6275 439/352 |

* cited by examiner

PULL TAB DEVICE FOR A LATCH OF A PLUGGABLE MODULE

BACKGROUND OF THE INVENTION

The subject matter herein relates generally to a device for releasing a latch of a pluggable module.

At least some known communication systems include receptacle assemblies, such as input/output (I/O) connector assemblies, that are configured to receive a pluggable module and establish a communicative connection between the pluggable module and an electrical communication connector of the receptacle assembly. As one example, a known receptacle assembly includes a cage member that is mounted to a circuit board and configured to receive a small form-factor pluggable (SFP) transceiver in an elongated cavity of the cage member. The pluggable module and the electrical connector have respective electrical contacts that engage one another to establish a communicative connection.

To retain the pluggable module in the cage member, the pluggable modules typically include a latch configured to engage the cage member. The latch is released by pushing downward on an actuator or pulling rearward on the actuator, such as using a tether. Conventional latches are not without disadvantages. For instance, some known latches overmold the tether directly to the stamped metal latch. The tether is then integrally secured to the latch and extends from the pluggable module, which may be costly to manufacture and assemble. The tether is pre-assembled to the latch. The tether is unable to be applied to the latch after the latch is assembled to the pluggable module.

A need remains for a latch release device that may be easily assembled to a latch of a pluggable module.

BRIEF DESCRIPTION OF THE INVENTION

In one embodiment, a pluggable module is provided including a pluggable body extending along a longitudinal axis between a cable end and a mating end opposite the cable end and a latch held by the pluggable body. The latch having an actuation end and a latching end opposite the actuation end. The actuation end has an actuator extending from the cable end and the latching end has a latching tooth configured to latchably secure the pluggable module to a component when the latching tooth is in a latching position. A pull tab device is secured to the actuator. The pull tab device has a handle configured to be pulled away from the pluggable body to release the latch. The pull tab device has a connecting end opposite the handle having a first segment and a second segment. The first segment wraps around the actuator and is secured to the second segment such that the pull tab device is self-secured to the actuator.

In another embodiment, a pluggable module is provided including a pluggable body extending along a longitudinal axis between a cable end and a mating end opposite the cable end and a latch held by the pluggable body. The latch has an actuation end and a latching end opposite the actuation end. The actuation end has an actuator extending from the cable end and the latching end has a latching tooth configured to latchably secure the pluggable module to a component when the latching tooth is in a latching position. A pull tab device is secured to the actuator. The pull tab device has a handle configured to be pulled away from the pluggable body to release the latch. The pull tab device has a connecting end opposite the handle having a button configured to releasably secure the pull tab device to the actuator. The connecting end has a stud provided along a first segment of the pull tab device and the connecting end has a socket along a second segment of the pull tab device. The connecting end wraps around the actuator such that the socket receives and engages the stud to secure the first segment to the second segment around the actuator.

In a further embodiment, a pull tab device is provided for actuating a latch of a pluggable module that includes a molded body extending between a pulling end and a connecting end. The connecting end has a folded-over portion between the pulling end and the connecting end. A handle is provided at the pulling end configured to be pulled away from the pluggable module to release the latch of the pluggable module. A button is provided at the connecting end configured to releasably secure the pull tab device to the latch. The button includes a stud provided along a first segment of the molded body and a socket provided along a second segment of the molded body. The folded-over portion is provided between the first and second segments and is configured to wrap around the latch such that the first segment is stacked with the second segment to align the stud with the socket. The socket receives and engages the stud to secure the first segment to the second segment around the latch.

DETAILED DESCRIPTION OF THE INVENTION

Figure 1:
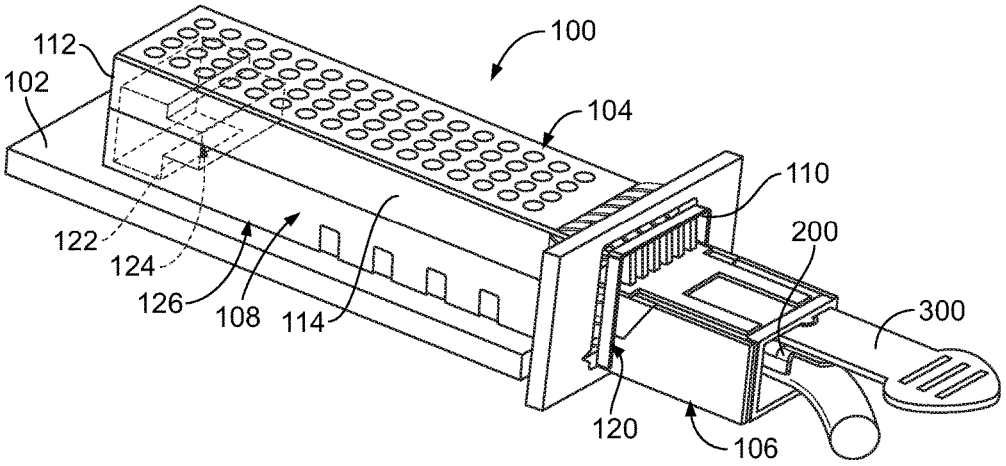
FIG. 1 is a front perspective view of a communication system in accordance with an embodiment.

FIG. 1 is a front perspective view of a communication system 100 in accordance with an embodiment. The communication system 100 includes a circuit board 102, a receptacle assembly 104 mounted to the circuit board 102, and one or more pluggable modules 106 that are configured to communicatively engage the receptacle assembly 104. The communication system 100 may be part of or used with telecommunication systems or devices. For example, the communication system 100 may be part of or include a switch, router, server, hub, network interface card, or storage system. The circuit board 102 may be a daughter card or a motherboard and include conductive traces (not shown) extending therethrough.

The receptacle assembly 104 includes a receptacle housing 108 that is mounted to the circuit board 102. The receptacle housing 108 may also be referred to as a receptacle cage. The receptacle housing 108 may be arranged at a bezel or faceplate 109 of a chassis of the system or device, such as through an opening in the faceplate. As such, the receptacle housing 108 is interior of the device and corresponding faceplate and the pluggable module(s) 106 is loaded into the receptacle housing 108 from outside or exterior of the device and corresponding faceplate. Optionally, the receptacle assembly 104 may be provided with heat exchangers for dissipating heat from the pluggable modules 106.

In the illustrated embodiment, the receptacle assembly 104 is illustrated as a single port receptacle assembly configured to receive a single pluggable module 106; however, the receptacle assembly 104 may be a multi-port receptacle assembly in other embodiments configured to receive pluggable modules 106 in multiple ports. For example, the multiple ports of the receptacle assembly 104 may be ganged side-by-side and/or stacked in addition to, or alternative to, ganged ports.

The receptacle housing 108 includes a front end 110 and an opposite back end 112. The front end 110 may be provided at, and extend through an opening in, the faceplate 109. Relative or spatial terms such as "front," "back," "top," or "bottom" are only used to distinguish the referenced elements and do not necessarily require particular positions or orientations in the communication system 100 or in the surrounding environment of the communication system 100. For example, the front end 110 may be located in or facing a back portion of a larger telecommunication system. In many applications, the front end 110 is viewable to a user when the user is inserting the pluggable module 106 into the receptacle assembly 104. In other examples, the top and bottom may be referenced to the circuit board 102 with the bottom positioned closer to the circuit board and the top positioned further from the circuit board. The top may be positioned below the bottom in some orientations. The top and the bottom may be horizontally aligned in other orientations, such as when the circuit board 102 is oriented vertically as opposed to horizontally.

The receptacle housing 108 is configured to contain or block electromagnetic interference (EMI) and guide the pluggable module(s) 106 during a mating operation. To this end, the receptacle housing 108 includes a plurality of housing walls 114 that are interconnected with one another to form the receptacle housing 108. The housing walls 114 may be formed from a conductive material, such as sheet metal and/or a polymer having conductive particles. In the illustrated embodiment, the housing walls 114 are stamped and formed from sheet metal. In some embodiments, the receptacle housing 108 is configured to facilitate airflow through the receptacle housing 108 to transfer heat (or thermal energy) away from the receptacle assembly 104 and pluggable module(s) 106. For example, airflow openings may be provided in the housing walls 114 to allow airflow through the receptacle housing 108. The air may flow from inside the receptacle housing 108 to the external environment or from outside the receptacle housing 108 into the interior of the receptacle housing 108. Fans or other air moving devices may be used to increase airflow through the receptacle housing 108 and over the pluggable module(s) 106.

The receptacle housing 108 defines a module cavity 120 extending between the front and back ends 110, 112. The module cavity 120 receives the pluggable module 106. The housing walls 114 surround and provide shielding for the module cavity 120 and the corresponding pluggable module(s) 106. The module cavity 120 extends lengthwise in a direction that is parallel to the plugging axis of the pluggable module 106. For a multi-port receptacle assembly 104, multiple module cavities 120 or ports are defined for receiving multiple pluggable modules 106. In such embodiments, the module cavities 120 may be stacked vertically and/or ganged horizontally.

The receptacle assembly 104 includes a communication connector 122 (shown in phantom in FIG. 1) having a mating interface 124 for mating with the pluggable module 106. The communication connector 122 may have multiple mating interfaces when configured to mate with multiple pluggable modules 106, such as when used in a stacked cage member. The communication connector 122 is disposed at the back end of the module cavity 120. In an exemplary embodiment, the communication connector 122 is provided at or near the back end 112 of the receptacle housing 108. The communication connector 122 includes electrical contacts (not shown) that are configured to be mated with the pluggable module 106. The communication connector 122 is configured to be mounted to the circuit board 102. The communication connector 122 is configured to be received in the receptacle housing 108 through a bottom 126 of the receptacle housing 108. For example, the receptacle housing 108 is configured to be mounted to the circuit board 102 over the communication connector 122 such that the communication connector 122 passes through an opening in the bottom 126 as the receptacle housing 108 is mounted to the circuit board 102.

The pluggable module 106 is an input/output (I/O) module configured to be inserted into and removed from the receptacle assembly 104. In some embodiments, the pluggable module 106 is a small form-factor pluggable (SFP) transceiver or quad small form-factor pluggable (QSFP) transceiver. The pluggable module 106 may satisfy certain technical specifications for SFP or QSFP transceivers, such as Small-Form Factor (SFF)-8431. In some embodiments, the pluggable module 106 is configured to transmit data signals up to 2.5 gigabits per second (Gbps), up to 5.0 Gbps, up to 10.0 Gbps, or more. By way of example, the receptacle assembly 104 and the pluggable module 106 may be similar to the receptacle cages and transceivers, respectively, which are part of the SFP+ product family available from TE Connectivity.

The pluggable module 106 includes a latch 200 for securing the pluggable module 106 in the receptacle housing 108. The latch 200 is releasable, such as by pulling on the latch 200 to release the latch 200 from the receptacle housing 108. A pull tab device 300 is coupled to the latch 200 for actuating the latch 200. In an exemplary embodiment, the pull tab device 300 is removably coupled to the latch 200. The pull tab device 300 may be field installable on the latch 200. For example, the pull tab device 300 is configured to be secured to the latch 200 when the pluggable module 106 is mated with the communication connector 122 without unmating the pluggable module 106 from the communication connector 122. As such, the pull tab device 300 may be retrofit to pluggable modules 106 without interrupting operation of the pluggable module 106 or communication system 100. The pull tab device 300 may be rear loaded onto the latch 200 in situ after the latch 200 is assembled to the pluggable module 106. The pull tab device 300 may be snapably coupled to itself around the latch 200 and is thus capable of being self-secured to the latch 200. The pull tab device 300 may be removed and replaced, such as when the pull tab device 300 is damaged.

Figure 2:
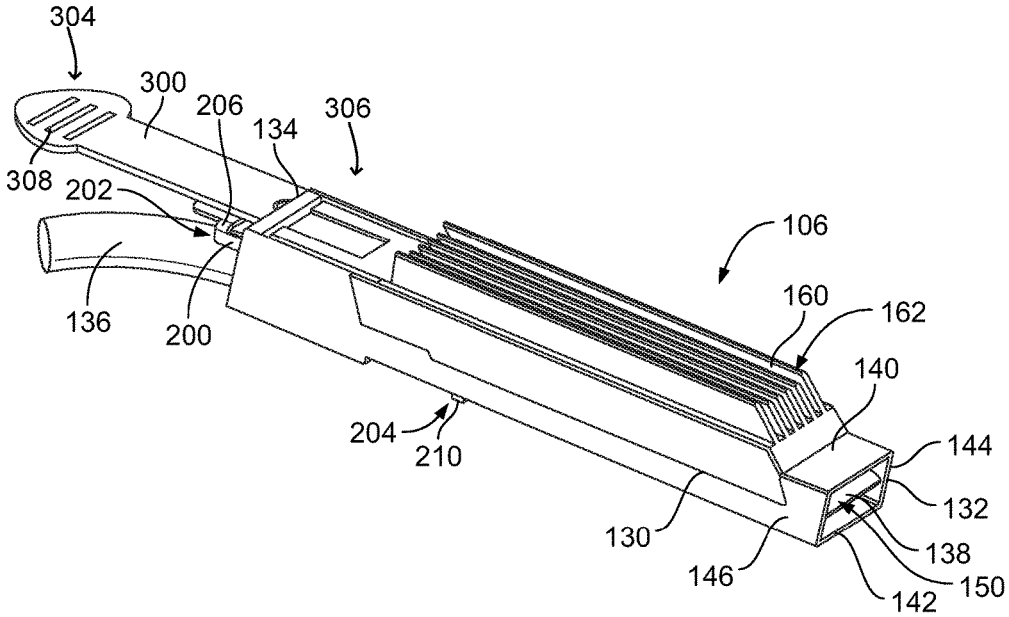
FIG. 2 is a front perspective view of a pluggable module of the communication system having a pull tab device for a latch in accordance with an exemplary embodiment.

FIG. 2 is a front perspective view of the pluggable module 106 in accordance with an exemplary embodiment. The pluggable module 106 has a pluggable body 130 extending between a mating end 132 at a back of the pluggable module and an opposite cable end 134 at a front of the pluggable module 106. A cable 136 extends from the pluggable body 130 at the cable end 134. The pluggable body 130 also includes an internal circuit board 138 that is communicatively coupled to electrical wires or optical fibers (not shown) of the cable 136. The internal circuit board 138 includes contact pads at the mating end 132 configured to be mated with the communication connector 122 (shown in FIG. 1). The mating end 132 is configured to be inserted into the module cavity 120 (shown in FIG. 1) of the receptacle housing 108 and advanced in a mating direction to mate with the communication connector 122. In an exemplary embodiment, the pluggable body 130 provides heat transfer for the internal circuit board 138, such as for the electronic components on the internal circuit board 138. For example, the internal circuit board 138 is in thermal communication with the pluggable body 130 and the pluggable body 130 transfers heat from the internal circuit board 138.

The pluggable module 106 is illustrated as a finned pluggable module providing heat dissipating fins for increased heat transfer and cooling of the pluggable module 106; however, other types of pluggable modules 106 may be provided in alternative embodiments. The pluggable body 130 has a first wall or top wall 140 and an opposite second wall or bottom wall 142 with side walls 144, 146 extending between the top and bottom walls 140, 142. The top and bottom walls 140, 142 and the sidewalls 144, 146 extend lengthwise along a length of the pluggable body 130 between the mating end 132 and the cable end 134. The top wall 140, bottom wall 142 and sidewalls 144, 146 define a chamber 150 that holds the internal circuit board 138. The cable 136 may extend into the chamber 150 for connection with the internal circuit board 138. Optionally, the internal circuit board 138 may be exposed at the mating end 132 for mating with the corresponding communication connector 122 (shown in FIG. 2).

In an exemplary embodiment, the pluggable body 130 includes a plurality of heat transfer fins 160 extending therefrom. The heat transfer fins 160 increase the surface area of the pluggable body 130 and allow greater heat transfer from the pluggable body 130. The heat transfer fins 160 may extend from any portion of the pluggable body 130, such as from the top wall 140. The heat transfer fins 160 run lengthwise at least partially between the cable end 134 and the mating end 132. Optionally, the heat transfer fins 160 may run substantially the entire length from the cable end 134 to the mating end 132. In the illustrated embodiment, the heat transfer fins 160 are parallel plates that extend continuously between opposite ends of the heat transfer fins 160. The heat transfer fins 160 are separated by channels 162. Optionally, the channels 162 may have a uniform spacing between the heat transfer fins 160. For example, sides of the heat transfer fins 160 may be planar and parallel.

The latch 200 is held by the pluggable body 130. The latch 200 has an actuation end 202 and a latching end 204 opposite the actuation end 202. The latch 200 is received in the pluggable body 130 such that the latching end 204 is located within the chamber 150 and the actuating end 202 is located outside of the pluggable body 130, such as forward of the pluggable body 130. The latch 200 extends from the cable end 134 forward of the pluggable body 130. The latch 200 extends into the chamber 150 such that a portion of the latch 200 is interior of the pluggable body 130 and a portion of the latch 200 is exterior of the pluggable body 130. The actuation end 202 has an actuator 206 configured to be pulled to release the latch 200. In an exemplary embodiment, the pull tab device 300 is coupled to the actuator 206 and provides a pulling feature for a user to actuate the latch 200. The latching end 204 has at least one latching tooth 210 (in an exemplary embodiment, the latch 200 includes two latching teeth 210) configured to latchably secure the pluggable module 106 to a component, such as one of the housing walls 114 (shown in FIG. 1) of the receptacle housing 108 (for example, at the bottom 126). The latching tooth 210 is movable between a latching position and a released position. For example, actuation of the latch 200 causes the latching tooth 210 to lift or rotate upward from the latching position to the released position.

The pull tab device 300 has a molded body 302 extending between a pulling end 304 and a connecting end 306. A handle 308 is provided at the pulling end 304 and is configured to be pulled away from the pluggable module 106 to release the latch 200. The handle 308 may include gripping features, such as ribs, on the top and/or bottom for grip on the handle 308. A self-securing feature 310 is provided at the connecting end 306 for releasably securing the pull tab device 300 to the latch 200. In the illustrated embodiment, the self-securing feature 310 is in the form of a snapable button; however, other types of self-securing features may be used in alternative embodiments.

Figure 3:
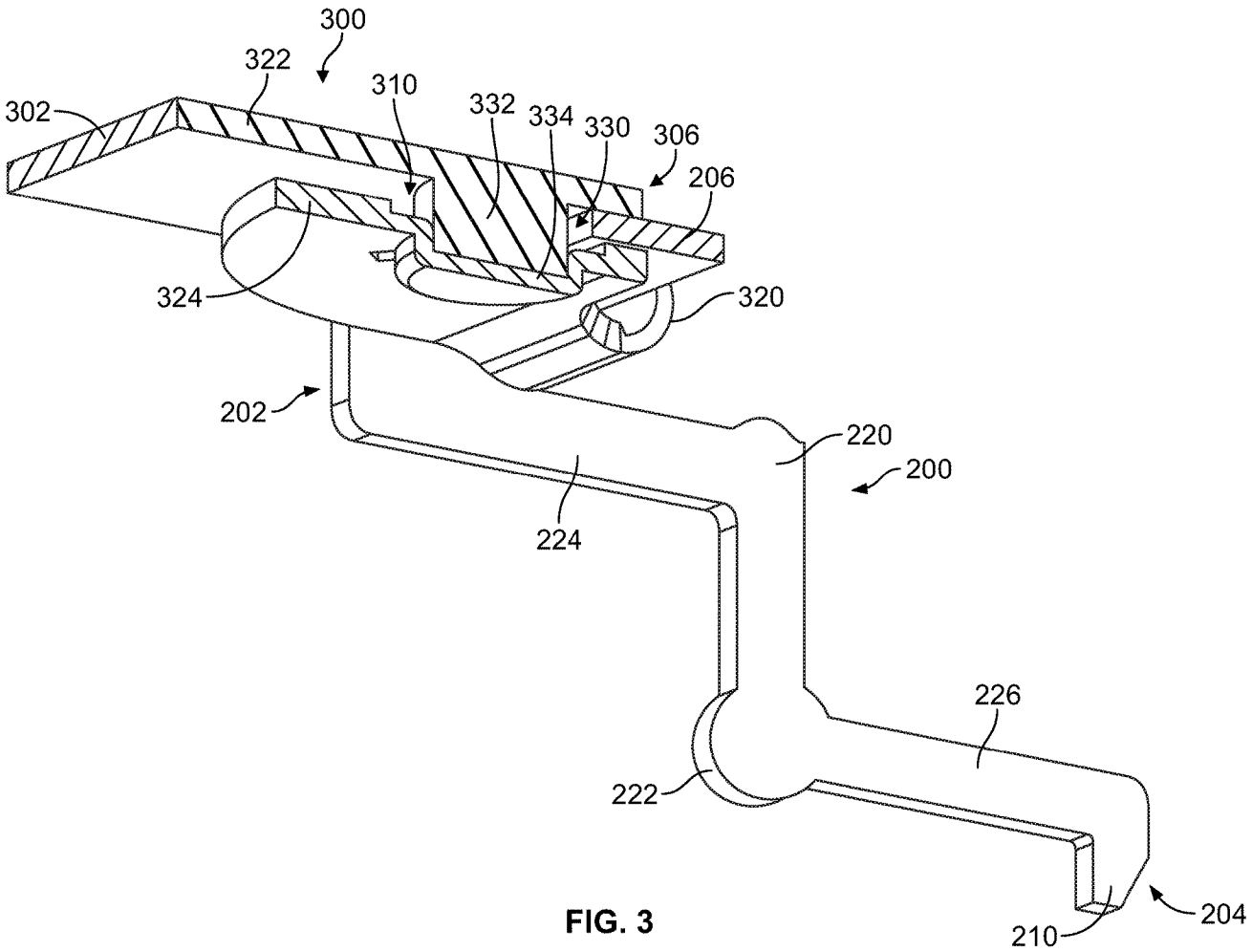
FIG. 3 is a bottom perspective, partial sectional view of the latch and the pull tab device in accordance with an exemplary embodiment.

FIG. 3 is a bottom perspective, partial sectional view of the latch 200 showing the pull tab device 300 connected to the latch 200 in accordance with an exemplary embodiment. In the illustrated embodiment, the latch 200 is a unitary one-piece structure including the actuator 206 at the actuation end 202 and the latching tooth 210 at the latching end 204 (only half of the latch 200 is shown in FIG. 3, wherein the latch 200 would include a second latching tooth 210 in various embodiments). The latch 200 is stamped and formed from a stock piece of metal and formed into a predetermined shape including the actuator 206 and the latching teeth 210. In the illustrated embodiment, the actuator 206 extends straight across at the actuation end 202; however, the actuator 206 may have other shapes in alternative embodiments, such as a curved U-shape.

The latch 200 includes a latching arm 220 extending rearward from the actuator 206 to the latching end 204. Optionally, the latching arm 220 may be bent or include jogs for positioning the latching tooth 210 relative to the actuator 206. The latching arm 220 may include a pivot joint 222, such as approximately centered between the latching tooth 210 and the actuator 206. The latch 200 may pivot about the pivot joint 222, such as when the actuator 206 is pulled by the pull tab device 300. The latching arm 220 may include a pulling arm 224 between the pivot joint 222 and the actuator 206, and a lifting arm 226 between the pivot joint 222 and the latching tooth 210. Pulling on the pull tab device 300 causes the pulling arm 224 to rotate the lifting arm 226 about the pivot joint 222. The pivot joint 222 transfers pulling movement of the actuator 206 in an actuation direction to unlatching movement of the latching tooth 210 in a releasing direction.

The connecting end 306 has a folded-over portion 320 between a first segment 322 and a second segment 324 of the connecting end 306. The first segment 322 is configured to be coupled to the second segment 324 by the self-securing feature 310. For example, the first segment 322 may be snapably coupled to the second segment 324. The first segment 322 is separable from the second segment 324 for repeatable mating and unmating of the connecting end 306 to itself.

The folded-over portion 320, the first segment 322 and the second segment 324 are integral parts of the molded body 302 of the pull tab device 300. The folded-over portion 320 wraps around the actuator 206 to secure the connecting end 306 to the actuator 206. When assembled, the first segment 322 and the second segment 324 are stacked. For example, the first segment 322 is wrapped under the second segment

324 and both the first segment 322 and the second segment 324 extend forward of the actuator 206. The folded-over portion 320 extends rearward of the actuator 206 when the connecting end 306 is wrapped around the actuator 206.

In an exemplary embodiment, the self-securing feature 310 is a button 330 provided at the connecting end 306 configured to releasably secure the pull tab device 300 to the latch 200. The button 330 includes a stud 332 and a socket 334. The stud 332 is provided along the first segment 322 and the socket 334 is provided along the second segment 324. The stud 332 and the socket 334 are integrally molded with the molded body 302 of the pull tab device 300.

When assembled, the folded-over portion 320 is provided between the first and second segments 322, 324 and is wrapped around the latch 200 such that the first segment 322 is stacked with the second segment 324 to align the stud 332 with the socket 334. The stud 332 may then be snapably secured to the socket 334. For example, the socket 334 receives and engages the stud 332 to secure the first segment 322 to the second segment 324 around the latch 200. The snapable button 330 is used to self-secure the first segment 322 to the second segment 324.

Figure 4:
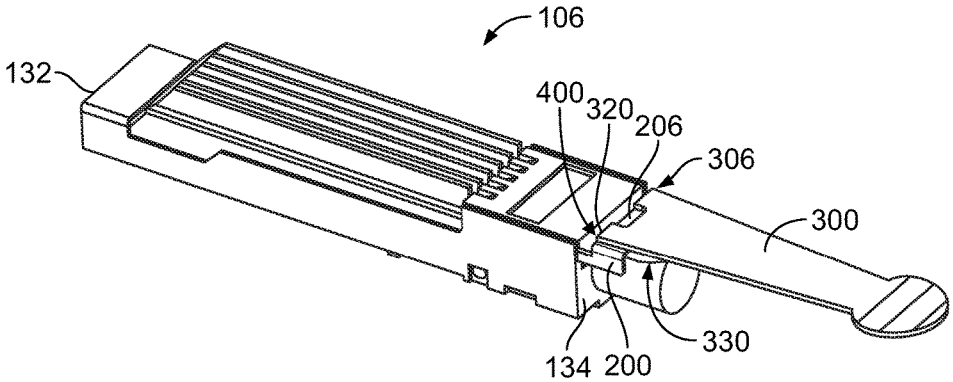
FIG. 4 is a rear perspective view of the pluggable module showing the pull tab device attached to the latch.
Figure 5:
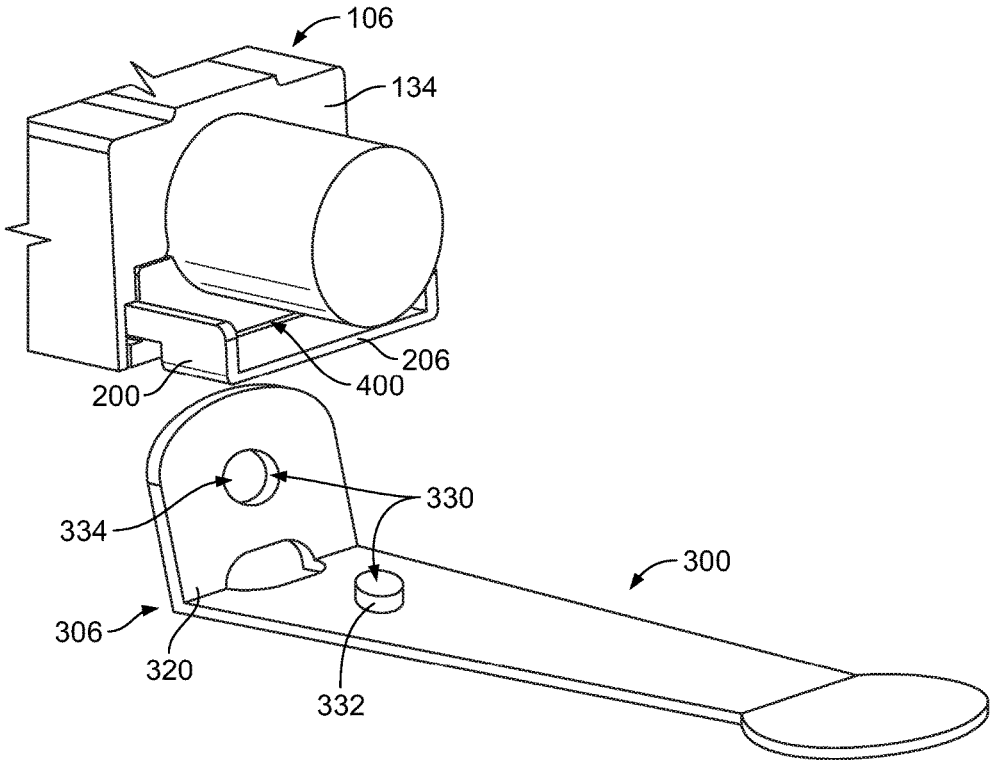
FIG. 5 is a rear perspective view of a portion of the pluggable module showing the pull tab device poised for coupling to the latch.

FIG. 4 is a rear perspective view of the pluggable module 106 showing the pull tab device 300 attached to the latch 200. FIG. 5 is a rear perspective view of a portion of the pluggable module 106 showing the pull tab device 300 poised for coupling to the latch 200. The latch 200 extends from the cable end 134 such that the actuator 206 is spaced apart from the cable end 134 such that a gap 400 is defined between the actuator 206 and the cable end 134. The connector end 306 passes through the gap 400 as the connector end 306 is wrapped around the actuator 206 such that a portion of the connecting end 306 (for example, the folded-over portion 320) is positioned between the actuator 206 and the cable end 134. The connector end 306 is self-secured by snapping the button 330 closed, such as by plugging the stud 332 into the socket 334. The pull tab device 300 may be secured to the actuator 206 when the mating end 132 of the pluggable module 106 is mated with the communication connector 122 (shown in FIG. 1) without unmating the mating end 132 from the communication connector 122.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A pluggable module comprising:

a pluggable body extending along a longitudinal axis between a cable end and a mating end opposite the cable end;

a latch held by the pluggable body, the latch having an actuation end and a latching end opposite the actuation end, the actuation end having an actuator extending from the cable end, the latching end having a latching tooth configured to latchably secure the pluggable module to a component when the latching tooth is in a latching position; and a pull tab device secured to the actuator, the pull tab device having a molded body including a handle configured to be pulled away from the pluggable body to release the latch, the molded body of the pull tab device having a connecting end opposite the handle, the molded body having a first surface and a second surface at the connecting end, the first surface being non-planar having a stud extending therefrom and a socket formed therein formed from the molded body, the connecting end having a first segment with the stud and a second segment with the socket, the first segment wrapping around the actuator such that the first surface of the first segment faces the first surface of the second segment with the stud being received in the socket to secure the first segment to the second segment such that the pull tab device is self-secured to the actuator, wherein the stud and the socket at the connecting end defines a snapable button to self-secure the first segment to the second segment.

2. The pluggable module of claim 1, wherein the first segment is snapably coupled to the second segment.

3. The pluggable module of claim 1, wherein the first segment is separable from the second segment for repeatable mating and unmating of the connecting end to itself.

4. The pluggable module of claim 1, wherein the snapable button is integrally molded with the first segment and the second segment as part of a unitary, one piece structure.

5. The pluggable module of claim 1, wherein the second surface of the second segment is non-planar surrounding the socket of the button, the socket receiving and engaging the stud to connect the button.

6. The pluggable module of claim 1, wherein the stud and the socket are integrally molded with a molded body of the pull tab device.

7. The pluggable module of claim 1, wherein the connecting end includes a folded-over portion between the first and second segments, the folded-over portion wrapping around the actuator such that the first and second segments are stacked and engage each other.

8. The pluggable module of claim 1, wherein the pull tab device is field installable on the actuator.

9. The pluggable module of claim 1, wherein the pull tab device is configured to be secured to the actuator when the mating end is mated with a communication connector without unmating the mating end from the communication connector.

10. The pluggable module of claim 1, wherein a portion of the connecting end is positioned between the actuator and the cable end of the pluggable body.

11. The pluggable module of claim 1, wherein the actuation end includes a latching arm extending from the actuator into the pluggable body, the latching arm holding the actuator spaced apart from the cable end of the pluggable body such that a gap is defined between the actuator and the cable end, the connector end passing through the gap as the connector end is wrapped around the actuator.

12. A pluggable module comprising:

a pluggable body extending along a longitudinal axis between a cable end and a mating end opposite the cable end;

a latch held by the pluggable body, the latch having an actuation end and a latching end opposite the actuation end, the actuation end having an actuator extending from the cable end, the latching end having a latching tooth configured to latchably secure the pluggable module to a component when the latching tooth is in a latching position; and a pull tab device secured to the actuator, the pull tab device having a handle configured to be pulled away from the pluggable body to release the latch, the pull tab device having a connecting end opposite the handle having a button configured to releasably secure the pull tab device to the actuator, the button having a stud provided along a first segment of the pull tab device and the button having a socket along a second segment of the pull tab device, the stud and the socket being integrally molded with the first segment and the second segment as part of a unitary, one piece structure, the connecting end being non-planar along the stud and the socket, the connecting end wrapping around the actuator such that the socket receives and engages the stud to secure the first segment to the second segment around the actuator.

13. The pluggable module of claim 12, wherein the stud is snapably coupled to the socket.

14. The pluggable module of claim 12, wherein the first segment is separable from the second segment for repeatable mating and unmating of the connecting end.

15. The pluggable module of claim 12, wherein the stud and the socket are integrally molded with a molded body of the pull tab device.

16. The pluggable module of claim 12, wherein the connecting end includes a folded-over portion between the first and second segments, the folded-over portion wrapping around the actuator such that the first and second segments are stacked and engage each other.

17. A pull tab device for actuating a latch of a pluggable module, the pull tab device comprising:

a molded body extending between a pulling end and a connecting end, the connecting end having a folded-over portion, the molded body being non-planar at the connecting end;

a handle provided at the pulling end configured to be pulled away from the pluggable module to release the latch of the pluggable module;

a button provided at the connecting end configured to releasably secure the pull tab device to the latch, the button comprising a stud and a socket, the stud provided along a first segment of the molded body and the socket provided along a second segment of the molded body, wherein the folded-over portion is provided between the first and second segments and is configured to wrap around the latch such that the first segment is stacked with the second segment to align the stud with the socket, the socket receives and engages the stud to secure the first segment to the second segment around the latch.

18. The pull tab device of claim 17, wherein the stud is snapably coupled to the socket.

19. The pull tab device of claim 17, wherein the first segment is separable from the second segment for repeatable mating and unmating of the connecting end to itself.

20. The pull tab device of claim 17, wherein the stud and the socket are integrally molded with a molded body of the pull tab device.

* * * * *